US006697592B2

(12) United States Patent
Adachi et al.

(10) Patent No.: US 6,697,592 B2
(45) Date of Patent: Feb. 24, 2004

(54) DEVELOPING DEVICE, AND IMAGE FORMING DEVICE HAVING THE SAME

(75) Inventors: Katsumi Adachi, Nara (JP); Masamitsu Sakuma, Hirakata (JP); Taisuke Kamimura, Kitakatsuragi-gun (JP); Kiyoshi Toizumi, Nara (JP); Toshimitsu Gotoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/363,718

(22) PCT Filed: Jun. 26, 2002

(86) PCT No.: PCT/JP02/06446

§ 371 (c)(1),
(2), (4) Date: Mar. 7, 2003

(87) PCT Pub. No.: WO03/003125

PCT Pub. Date: Jan. 9, 2003

(65) Prior Publication Data

US 2003/0175052 A1 Sep. 18, 2003

(30) Foreign Application Priority Data

Jun. 27, 2001 (JP) ..... 2001-195281

(51) Int. Cl.[7] ..... G03G 15/08
(52) U.S. Cl. ..... 399/265; 399/107; 399/239
(58) Field of Search ..... 399/107, 222, 399/225, 239, 265, 266, 289, 290, 291, 292, 293

(56) References Cited

U.S. PATENT DOCUMENTS 5,602,632 A * 2/1997 Kuehnle ..... 399/265
6,175,707 B1 * 1/2001 Eklund et al. ..... 399/265

FOREIGN PATENT DOCUMENTS

| | | |
|---|---|---|
| JP | 59-181371 | 10/1984 |
| JP | 59-189371 | 10/1984 |
| JP | 05-346725 | 12/1993 |
| JP | 09-068864 | 3/1997 |
| JP | 2002-091160 | 3/2002 |

OTHER PUBLICATIONS

International Search Report (PCT/ISA/210) for PCT/JP02/06446 dated Aug. 23, 2002 2pp. (in Japanese) (second sheet with English Translation provided.).

* cited by examiner

*Primary Examiner*—Hoang Ngo
(74) *Attorney, Agent, or Firm*—Edwards & Angell, LLP; David G. Conlin; George W. Hartnell, III

(57) ABSTRACT

A developing device comprises: a toner carrying member (15) for carrying toner T towards a photosensitive drum, using a traveling wave electric field; a belt member (16) which is provided so as to cover the surface of the toner carrying member (15), the surface facing the photosensitive drum (2); a belt drive roller (18) which is in touch with the belt member (16) so as to rotate the belt member (16) around the toner carrying member (15); and a drive assistance roller (19) for sandwiching the belt member (16) with the belt drive roller (18). With this arrangement, it is possible to provide a developing device which is silent, small in size, and capable of reducing costs, and an image forming device including the developing device.

18 Claims, 7 Drawing Sheets

DEVELOPING DEVICE, AND IMAGE FORMING DEVICE HAVING THE SAME

TECHINICAL FIELD

The present invention relates to a developing device for developing an electrostatic latent image formed on an image supporter by means of a developing agent and an image forming device including the developing device, and particularly to a developing device in which the developing agent is carried using an electric field in which the distribution of electric potentials varies over time, in the manner of traveling waves having a predetermined direction of movement (hereinafter, the foregoing electric field will be simply referred to as a traveling wave electric field).

BACKGROUND ART

As a developing device used in image forming devices using an electronic photo process such as photocopiers and laser printers, what have particularly drawn attention are developing devices which carry out developing without causing an image supporter such as a photosensitive drum to contact with a developing agent carrier such as a developing sleeve. As such kinds of developing devices, for instance, developing devices of a powder cloud type, of a jumping development type, and of a traveling wave electric field type have been proposed.

As a developing device using a traveling wave electric field, Japanese Laid-Open Patent Application No. 59-181371/1984 (Tokukaisho 59-181371; published on Oct. 15, 1984) and Japanese Laid-Open Patent Application No. 59-189371/1984 (Tokukaisho 59-189371; published on Oct. 26, 1984) disclose respective developing devices.

These developing devices disclosed by the respective publications are both arranged in such a manner that a power source for generating alternating voltages each having a different phase and a plurality of electrodes provided on a plate-shaped developing agent carrying member at predetermined intervals are provided, and a developing agent is supplied to a photosensitive drum by means of a traveling wave electric field generated by applying the alternating voltages to the electrodes.

However, it is noted that these conventional arts have such problems as the generation of an electric charge on the developing agent carrying member and the adhesion of the developing agent to the developing agent carrying member.

When the developing agent carrying member is charged, the electric charge on the developing agent carrying member could disrupt the traveling wave electric field so as to have an adverse impact on the condition of the carrying of the developing agent, or could vary a developing electric field in the process of developing on the photosensitive drum so that the density of a developed image is varied. Also, the developing agent adhered on the developing agent carrying member could cause an adverse effect on the process of carrying the developing agent so that the irregularity of density is generated in a developed image.

To solve these problems, the inventors of the present invention have thought that a developing device including: a looped belt member for covering the developing agent carrying member; and a drive roller provided so as to be in touch with the inner surface of the belt member, so that (i) the discharge of the surface of the developing agent carrying member, the surface being used for carrying the developing agent, and (ii) the removal of the residual developing agent, are carried out by rotating the drive roller so as to move the belt member (Japanese Patent Application 2000-283087 (filed on Sep. 19, 2000)).

With the developing device of the foregoing patent application, it is possible to restrain the generation of the electric charge on the developing agent carrying member and the degradation of image quality due to the irregularity of density.

Now, if the developing agent carrying member is irregularly in touch with the belt member, the traveling wave electric field is irregularly formed on the surface of the belt member and this could hinder the developing agent from being stably carried. When the developing agent is not stably carried, the irregularity of density occurs in a developed image. For this reason, it is necessary to bring the developing agent carrying member into contact with the belt member evenly and almost absolutely.

However, provided that the developing agent carrying member is brought into contact with the belt member evenly and almost absolutely, the frictional force between the developing agent carrying member and the belt member causes the rotating belt member to be under load conditions. Thus, in the case of the developing device of the foregoing Patent Application, it is necessary to rotate the belt member by the drive roller in order to cope with the load associated with the friction force.

Thus, as in the following description, there are three methods of rotating the belt member.

The first method is to increase the driving force by increasing the tension of the belt member. However, this brings about such a problem that increasing the tension of the belt member increases the load due to the frictional force between the developing agent carrying member and the belt member.

The second method is to decrease the tension of the belt member so as to directly reduce the load caused by the frictional force between the developing agent carrying member and the belt member. However, when the tension of the belt member is decreased, a slight gap is produced between the developing agent carrying member and the belt member so that the belt member vibrates because of the traveling wave electric field formed on the developing agent carrying member, and hence unpleasant noise is made.

The third method is to increase the size of the drive roller in order to enlarge the contact area between the drive roller and the belt member. However, this increases the size of the developing device and also drives up the costs.

In summary, these three methods share such a common problem that it is difficult to realize an arrangement for rotating the belt member by the drive roller while keeping the developing agent carrying member to be in good contact with the belt member.

The present invention has been done in view of the foregoing problems, so that the object of the present invention is to offer a developing device which is quiet, small in size, and manufactured at low cost, and an image forming device including the developing device.

DISCLOSURE OF THE INVENTION

To solve the foregoing problems, a developing device in accordance with the present invention is characterized by comprising: developing agent carrying means for carrying a developing agent towards an image supporter, using an electric field in which distribution of electric potentials varies in a manner of traveling waves having a predetermined direction of movement; a belt member which is provided so as to cover a surface of the developing agent carrying means, the surface facing the image supporter; drive means which is in touch with the belt member, for rotating the belt member around the developing agent carrying means; and drive assistance means which is provided so as to sandwich the belt member with the drive means.

That is to say, the developing device of the present invention is arranged in such a manner that the developing agent carrying means carries the developing agent towards the image supporter using the electric field (traveling wave electric field) in which distribution of electric potentials varies in a manner of traveling waves having a predetermined direction of movement. In the developing device in accordance with the present invention, the surface of the developing agent carrying means could be charged due to the contact with the developing agent, and the developing agent could adhere to the developing agent carrying means. When such problems as the charging of the developing agent carrying means occur, there may be cases where the developing agent is not stably carried and the density of an image obtained by developing an electrostatic latent image is irregular.

Thus, the developing device of the present invention comprises the belt member provided so as to cover the surface of the developing agent carrying means, the surface facing the image supporter, and the drive means which is in touch with the belt member so as to rotate the belt member around the developing agent carrying member.

Rotating the belt member by the drive means makes it possible to cause the surface of the belt member, which is not charged or to which no developing agent adheres, to face the image supporter. With this arrangement, it is possible to stably carry the developing agent and to develop an image with little irregularity of density.

When the developing agent carrying means is irregularly in touch with the belt member, the traveling wave electric field appearing on the surface of the belt member, which is extended from the developing agent carrying means via the belt member, is also irregular so that it could be impossible to carry the developing agent stably.

In the meantime, when the developing agent carrying means is uniformly in touch with the belt member, the frictional force between the developing agent carrying member and the belt member causes the rotating belt member to be under load conditions.

For this reason, the developing device in accordance with the present invention particularly includes the drive assistance means provided so as to sandwich the belt member with the drive means. In other words, the belt means is sandwiched between the drive means and the drive assistance means. With this arrangement, the contact pressure between the drive means and the belt member is increased so that it is possible to rotate the belt member with the force stronger than the load caused by the frictional force between the developing agent carrying means and the belt member.

Moreover, since the driving force is enhanced by increasing the contact pressure between the drive means and the belt member, the drive means can rotate the belt member even if the belt member is at load conditions to some degree. Therefore, since it is unnecessary to lower the tension of the belt member in order to decrease the load, the generation of unpleasant noise caused by the vibration of the belt member can be prevented and hence the quietness of the device can be improved.

Moreover, in the foregoing arrangement, since the driving force of the drive means can be enhanced by increasing the force of sandwiching the belt member between the drive means and the drive assistance means, it is unnecessary to increase the size of the drive means in order to increase the contact area between the drive means and the belt member. Thus, it is possible to acquire sufficient driving force using small drive means, so that the developing device can be downsized and the costs thereof can be reduced.

For a fuller understanding of the nature of the invention, reference should be made to the ensuing detailed description taken in conjunction with the accompanying drawing.

BEST MODES FOR CARRYING OUT THE INVENTION

Embodiment 1

Referring to FIGS. 1 through 5, the following description will discuss an embodiment in accordance with the present invention.

Figure 2:
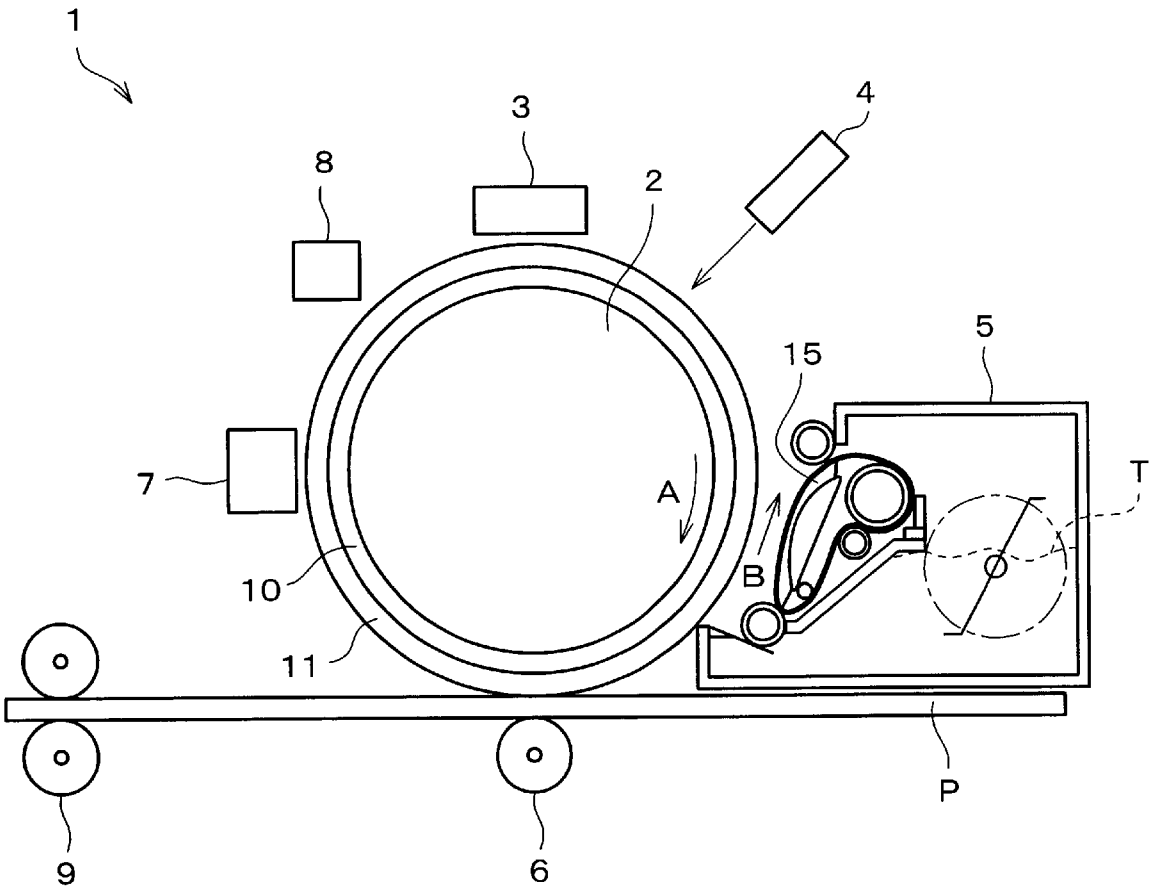
FIG. 2 is a schematic view, illustrating an image forming device including the developing device of FIG. 1.

As illustrated in FIG. 2, an image forming device 1 in accordance with the present embodiment includes: a photosensitive drum (image supporter) 2 which is cylindrical in shape and can rotate in the clockwise direction indicated by an arrow A in the figure; a charging device 3; an exposure device 4; a developing device 5; a transfer device 6; a cleaning device 7; a discharging device 8; and a fixing device 9. The charging device 3, the exposure device 4, the developing device 5, the transfer device 6, the cleaning device 7, and the discharging device 8 are provided in this order on the outer surface of the photosensitive drum 2, along the direction of the rotation of the photosensitive drum 2.

The photosensitive drum 2 is provided for supporting an electrostatic latent image formed by the exposure device 4. The outer surface of the photosensitive drum 2 is covered with a base material layer 10, and the outer surface of the base material layer 10 is further covered with a thin-film photoconductive layer 11. The base material layer 10 is made of metals such as aluminum, and the photoconductive layer 11 is made of materials such as amorphous silicon (a-Si), selenium (Se), and organic photoconductor (OPC).

The charging device 3 is provided for uniformly charging the photoconductive layer 11 on the surface of the photosensitive drum 2 to a predetermined degree. What can be used as the charging device 3 are such as: a corona charging device provided with a charging wire such as a tungsten wire, a shield plate made of metal, and a grid plate; a charging roller; and a charging brush.

The exposure device 4 is provided for causing the photoconductive layer 11, provided on the surface of the photosensitive drum 2 which has been charged by the charging device 3, to be exposed to a laser beam, etc. in accordance with, for instance, image data from a host computer, so as to form an electrostatic latent image on the photoconductive layer 11. As the exposure device 4, it is possible to adopt devices such as a semiconductor laser diode and a light emitting diode.

The developing device 5 is provided for supplying toner (developing agent) T on the surface of the photosensitive drum 2, so as to visualize an electrostatic latent image formed on the surface of the photosensitive drum 2, as a toner image. This developing device 5 is a characterizing portion of the present invention so that in the following passages, the developing device 5 will be discussed in detail.

The transfer device 6 is provided for transferring the toner image, which has been visualized on the surface of the photosensitive drum 2, to a recording medium P such as PPC (Print Paper Copy) paper. What can be adopted as the transfer device 6 are such as a corona transfer device, a transfer roller, and a transfer brush.

The cleaning device 7 is provided for removing residual matters such as the toner T and powdered paper from the surface of the photosensitive drum 2. As the cleaning device 7, it is possible to adopt, for instance, a blade made of brass plate.

The discharging device 8 is provided for removing a residual electric charge on the surface of the photosensitive drum 2. As the discharging device 8, it is possible to adopt, for instance, a discharging lamp. The fixing device 9 is provided for transferring the toner image, which has been transferred to the recording medium P, to the surface of the recording medium P.

With the arrangement above, the image forming device 1 forms a desired image on the recording medium P, through a so-called electro-print process including the steps of charging by the charging device 3, exposing by the exposure device 4, developing by the developing device 5, and transferring by the transfer device 6.

Incidentally, as illustrated in FIG. 2, there is a certain distance between the photosensitive drum 2 and a below-mentioned toner carrying member (developing agent carrying means) 15 provided in the developing device 5, so that the developing device 5 is arranged so as to develop the electrostatic latent image on the photosensitive drum 2, without touching the drum 2. However, it is not necessary to adopt this arrangement in order to develop the electrostatic latent image on the photosensitive drum 2, and hence the development may be carried out by bringing the toner carrying member 15 into contact with the photosensitive drum 2.

Now, as stated above, the following description will discuss the developing device 5 which is the characterizing portion of the present invention more specifically.

Figure 1:
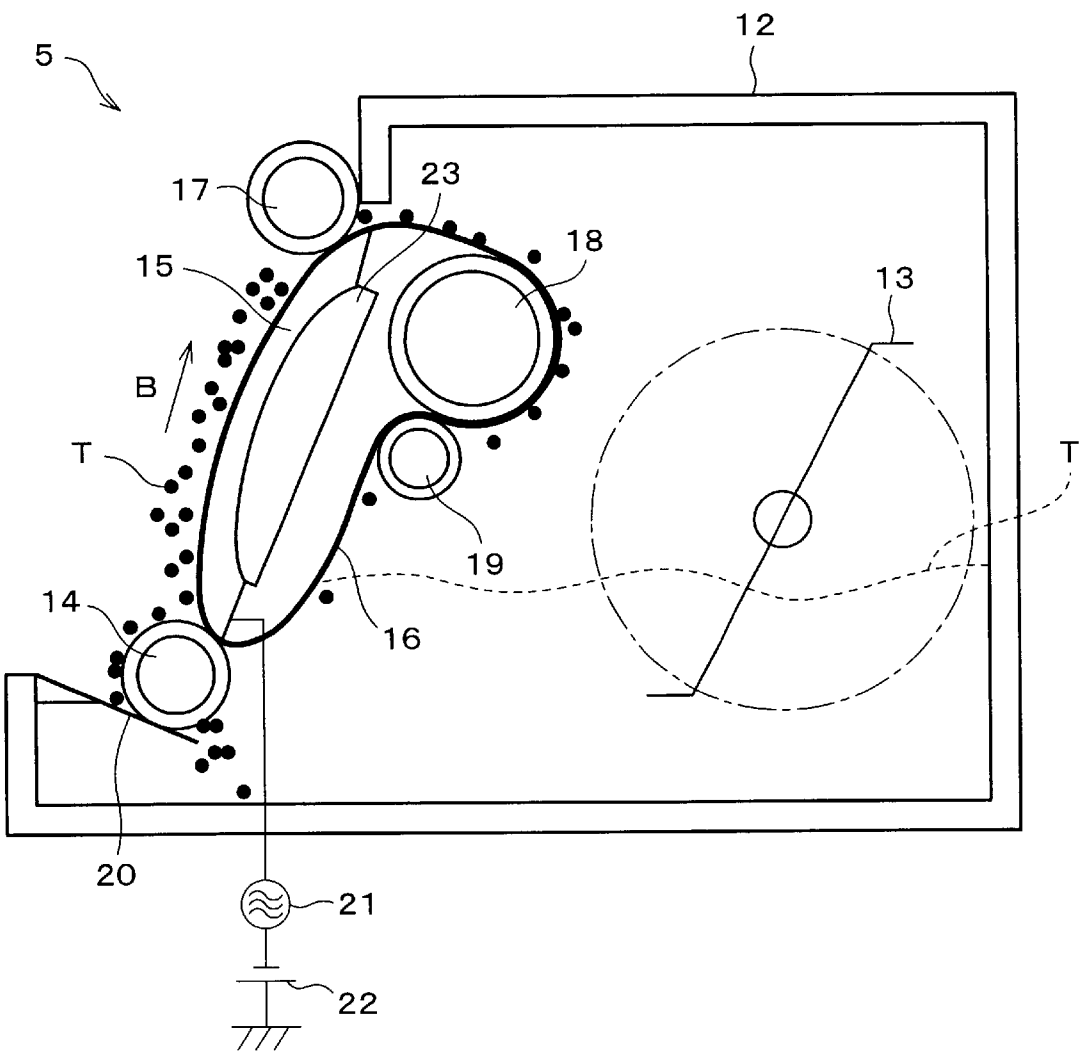
FIG. 1 is a schematic view, illustrating an embodiment of a developing device in accordance with the present invention.

As illustrated in FIG. 1, the developing device 5 is provided with: a housing 12; a mixing paddle 13; a toner supplying roller 14; a toner carrying member 15; a belt member 16; a toner reclaiming roller 17; a belt drive roller (drive means) 18; and a drive assistance roller (drive assistance means) 19.

The housing 12 is provided for accommodating the toner T therein and for supporting the members constituting the developing device 5 as occasion demands. The mixing paddle 13 is provided so as to rotate in the housing 12, for mixing the toner T with a carrier.

The toner supplying roller 14 is provided for supplying the toner T to the toner carrying member 15, and is in touch with the surface of the belt member 16 and freely rotates. The toner supplying roller 14 is made of, for instance, silicon, urethane, solid rubber which is EPDM (Ethylene Propylene Diene Methylene), or foam rubber.

Alternatively, it is possible to impart conductivity to the toner supplying roller 14 by applying substances such as a carbon black and an ionic conductive agent to the surface thereof. This arrangement makes it possible to electrostatic-absorb the toner T so as to supply the same to the toner carrying member 15. Also, it is possible to provide a sheet-shaped supplying blade 20 which is made of the materials identical with those of the toner supplying roller 14, and supply the toner T, which is electrostatic-absorbed by the supplying blade 20, to the toner carrying member 15.

The toner carrying member 15 is a plate-shaped member for generating a traveling wave electric field in order to carry the toner T on the belt member 16, and connected to a multiphase AC power source 21 and a developing bias power source 22. The arrangement for generating the traveling wave electric field by the toner carrying member 15 will be described in the following passages.

Moreover, the toner carrying member 15 is provided in the housing 12 with the assistance of a supporting member 23, so as to face the photosensitive drum 2 (c.f. FIG. 2). This supporting member 23 is provided for keeping the toner carrying member 15 to face the photosensitive drum 2, and can be made of materials such as ABS (Acrylonitrile-Butadiene-Styrene) resin.

Further, the surface of the toner carrying member 15, facing the photosensitive drum 2, is formed so as to have a curved shape bulging towards the photosensitive drum 2. Here, the shape of the surface of the toner carrying member 15, facing the photosensitive drum 2, is not limited to the foregoing curved shape, and hence the surface may have a hemispherical shape or a flat shape.

The belt member 16 is provided for preventing the generation of an electric charge on the toner carrying member 15, and also for preventing the adhesion of the toner T to the toner carrying member 15. The belt member 16 is provided so as to wrap the toner carrying member 15, and rotated in the direction indicated by an arrow B in FIG. 1 (in the direction opposite to the movement of a portion of the photosensitive drum 2, the portion facing the belt member 16) by the below-mentioned belt drive roller 18.

Here, the belt drive roller 18 imparts a certain degree of tension to the belt member 16 in order to make the belt member 16 in absolute contact with the toner carrying member 15. With this arrangement, the traveling wave electric field formed by the toner carrying member 15 uniformly affects the surface of the belt member 16.

Moreover, the belt member 16 is made of organic insulating materials such as polyimide, PET (polyethylene terephthalate), polytetrafluoroethylene, polyfluoroethyleneproplylene, and PTFE (polytetrafluoroethylene), rubber materials such as silicon, isoprene, butadiene, etc.

Further, the thickness of the belt member 16 is within the range of 5 $\mu$m–200 $\mu$m, and preferably within the range of 10 $\mu$m–100 $\mu$m. Also, it is preferable that the volume resistivity of the belt member 16 is within the grange of $1\times10^{8}$ Ω.cm to $1\times10^{16}$ Ω.cm. Incidentally, the reason why the volume resistivity is preferably within this range will be described in Example.

The toner reclaiming roller 17 is provided for gathering the toner T which does not contribute to the development of the electrostatic latent image formed on the photosensitive drum 2, so as to bring the gathered toner T back into the housing 12. The toner reclaiming roller 17 is in touch the belt member 16 on the downstream side of the rotative direction of the belt member 16, and freely rotates. The materials of the toner reclaiming roller 17 are identical with the toner supplying roller 14.

Incidentally, both the toner supplying roller 14 and the toner reclaiming roller 17 may not be in touch with the belt member 16, and may not rotate.

The belt drive roller 18, shaped like a cylinder, is provided for driving the belt member 16, discharging the belt member 16, and removing the toner T remained on the belt member 16. The belt drive member 18 is provided so as to be in touch with the inner surface of the belt member 16, and rotates at a predetermined peripheral velocity by a drive system (not illustrated).

Moreover, the belt drive roller 18 preferably drives the belt member 16 at a speed around 1/10 to 1/100 of the speed of carrying the toner T on the belt member 16. Here, it is possible to measure the speed of carrying the toner T by, for instance, providing two infrared sensors and measuring the times of reaching at the respective sensors, or using a high-speed video camera (c.f. IS & Ts NIP 15: 1999 International Conference on Digital Printing Technologies; pages 262–265).

Further, as the belt drive roller 18, it is possible to adopt a metal roller made of materials such as stainless steel (SUS) and iron. The surface of the belt drive roller 18 is covered with an elastic member made of materials such as silicon, urethane, solid rubber which is EPDM, foam rubber, film, sponge, etc.

Also, it is possible to impart conductivity to the surface of the belt drive roller 18 by applying substances such as a carbon black and an ionic conductive agent to the foregoing materials. The belt drive roller 18 may be shaped like a plate or a square column.

The drive assistance roller 19, formed like a cylinder whose diameter is shorter than that of the belt drive roller 18, is provided for enabling the belt drive roller 18 to drive the belt member 16 more efficiently, thereby the drive assistance roller 19 is provided so as to be in touch with the belt drive roller 18 via the belt member 16. To put it another way, the belt member 16 is sandwiched in between the belt drive roller 18 and the drive assistance roller 19, so that the contact pressure between the belt member 16 and the belt drive roller 18 is increased.

To further increase the foregoing contact pressure, it is possible to provide pressing means (not illustrated) such as a leaf spring and a coil spring, for pressing the belt member 16 on the belt drive roller 18.

Moreover, the drive assistance roller 19 is provided so as to be rotatable with respect to the housing 12. The rotation of the drive assistance roller 19 may be carried out: in accordance with the rotation of the belt member 16; by being connected to the belt drive roller 18 using a gear (not illustrated); being connected to the belt drive roller 18 using a pulley and a belt (both not illustrated); or using a driver other than the belt drive roller 18.

Further, the drive assistance roller 19 rotates a peripheral velocity different from the peripheral velocity of the belt drive roller 18. More preferably, the peripheral velocity of the drive assistance roller 19 is higher than that of the belt drive roller 18. As in the case of the belt drive roller 18, the drive assistance roller 19 may be shaped like a plate or a square column. Further, as the drive assistance roller 19, it is possible to adopt a metal roller made of materials such as stainless steel (SUS) and iron.

The surface of the drive assistance roller 19 is preferably covered with an elastic member made of materials such as rubber, film, sponge, etc. Also, it is possible to impart conductivity to the drive assistance roller 19 by applying substances such as a carbon black and an ionic conductive agent to these materials.

Moreover, it is preferable that the surface of the drive assistance roller 19 is covered with a member which is softer than the surface of the belt drive roller 18. The reason of this arrangement will be described below.

Further, provided that the friction coefficient between the belt member 16 and the belt drive roller 18 is $\mu1$ and the friction coefficient between the belt member 16 and the drive assistance roller 19 is $\mu2$, $\mu1$ and $\mu2$ are arranged so as to meet $\mu1>\mu2$.

With this arrangement, the developing device 5 supplies the toner T, which has been stirred in the housing 12 by the mixing paddle 13, to the belt member 16 by means of the toner supplying roller 14. Then the toner T which has been supplied to the surface of the belt member 16 is carried on the belt member 16 by the traveling wave electric field generated by the toner carrying member 15, so that the toner T is supplied to the photosensitive drum 2.

Next, the arrangement for generating the traveling wave electric field on the toner carrying member 15 will be described more specifically as below.

Figure 3:
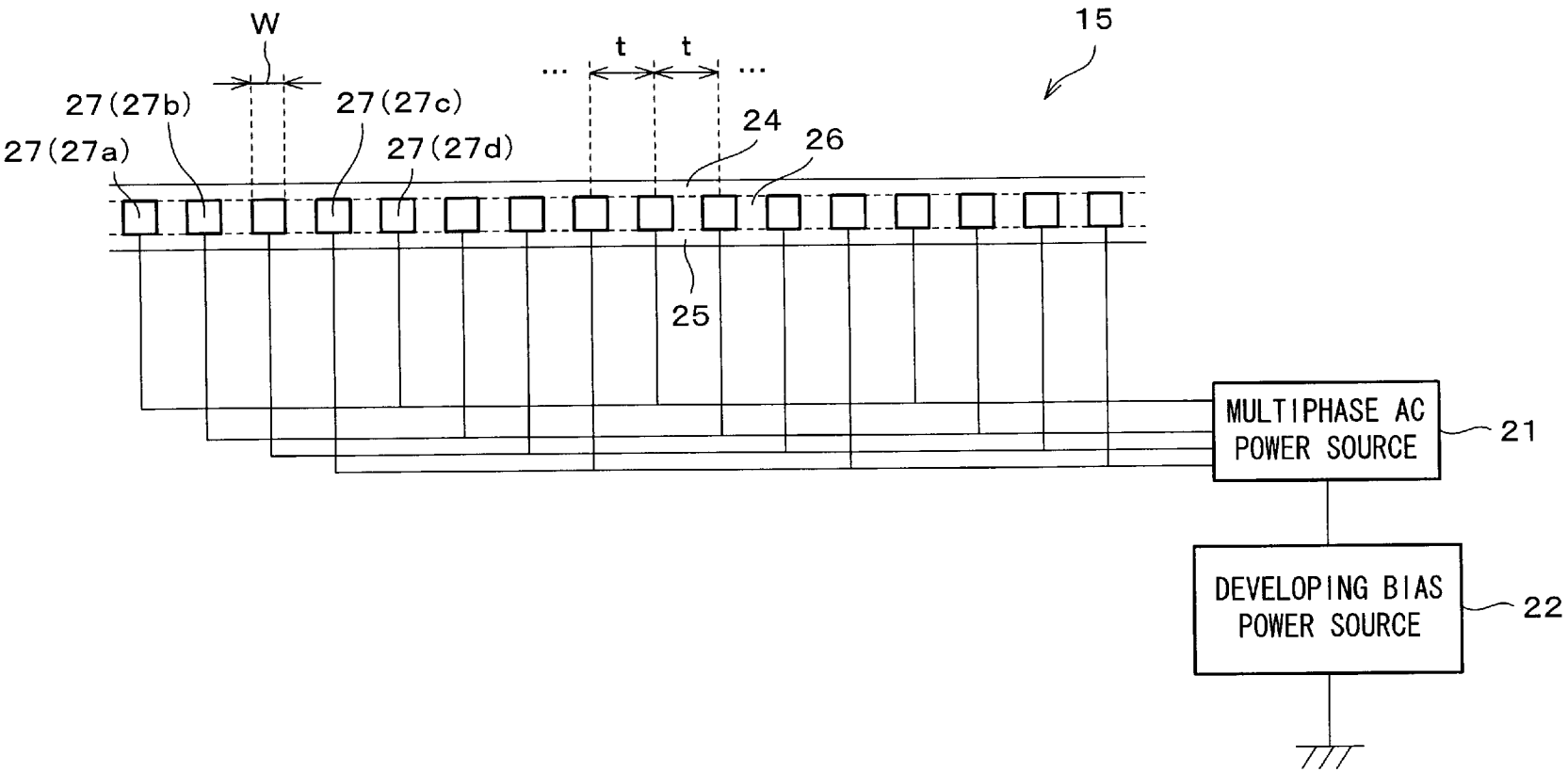
FIG. 3 is a schematic view, illustrating a toner carrying member of the developing device of FIG. 1.

As illustrated in FIG. 3, the toner carrying member 15 is made up of three layers being deposited. That is to say, the toner carrying member 15 is provided with: a surface protective layer 24 formed to face the photosensitive drum 2 (FIG. 2); a base material layer 25 formed inside the developing device 5 (FIG. 2); and an insulating layer 26 formed between the surface protective layer 24 and the base material layer 25.

It is possible to adopt a polyimide which is around 25 μm thick as both the surface protective layer 24 and the base material layer 25.

Moreover, in the insulating layer 26, a plurality of electrodes 27 are buried at intervals t. Each of the intervals t between the neighboring electrodes 27 is arranged so as to be within the range of 85 μm–500 μm (50 dpi–300 dpi). In accordance with the values of the respective intervals t between the electrodes 27, the width W of each of the electrodes 27 is set so as to be within the range of 40 μm–250 μm.

As each of the electrode 27, it is possible to adopt a copper electrode which is around 18 μm thick, and the electrodes 27 are connected to the multiphase AC power source 21 and the developing bias power source 22. Incidentally, this multiphase AC power source 21 generates alternating voltages of 4 phases. Provided that four consecutive electrodes 27 are seen as one group of electrodes 27*a*, 27*b*, 27*c*, and 27*d*, these four electrodes 27*a–d* of one group receive respective four alternating voltages each having a different phase.

Figure 4:
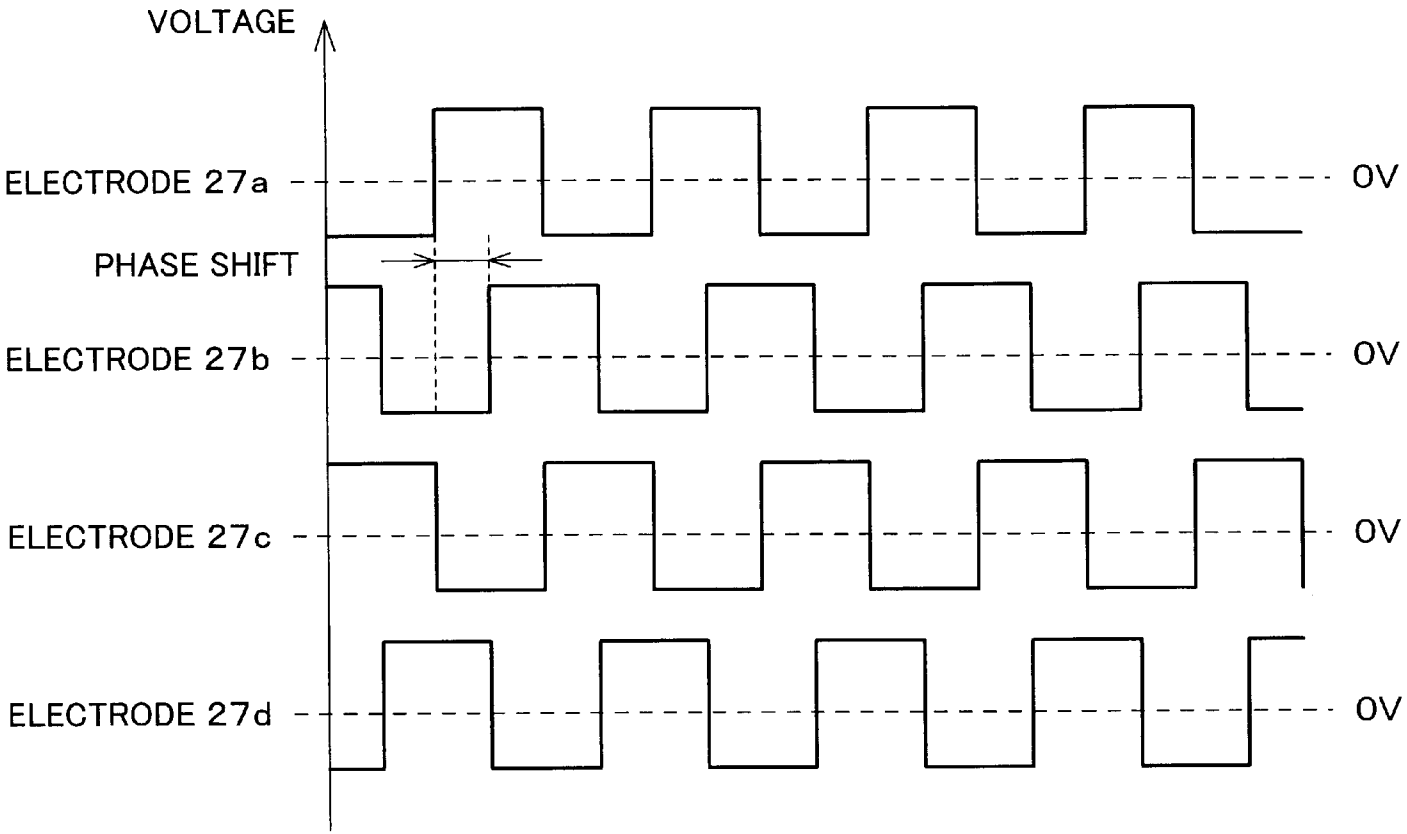
FIG. 4 illustrates an example of alternating voltages applied to electrodes of the toner carrying member in FIG. 3.

In other words, as illustrated in FIG. 4, provided that the four consecutive electrodes 27 are electrodes 27*a*, 27*b*, 27*c*, and 27*d*, these electrodes 27*a*–27*d* receive respective alternating voltages each having a different voltage waveform with a phase difference of 90°.

Here, the multiphase AC power source 21 may generate alternating voltages of 3 phases. In this case, it is possible to generate a traveling wave electric field by applying alternating voltages each having a phase difference of 120° to three consecutive electrodes 27, respectively.

Moreover, the waveforms of the respective alternating voltages generated by the multiphase AC power source 21 are not necessarily shaped like square waves as illustrated in FIG. 4, and hence these alternating voltages may be sine waves or trapezoidal waves. Also, the values of the respective alternating voltages are preferably within the range of 100V–3 kV, and the frequencies of the alternating voltages are preferably within the range of 100 Hz–5 kHz. Here, it is noted that the voltage values and the frequencies are appropriately set in accordance with the shape of electrodes 27, the speed of carrying the toner T, the type of the toner T, etc., so as not to be limited to the values described above.

In this manner, an electric field in which the distribution of electric potentials varies over time like a traveling wave having predetermined direction of movement, i.e. a traveling wave electric field is generated by applying alternating voltages, which are generated by the multiphase AC power source 21, to the electrodes 27 buried in the toner carrying member 15. With this traveling wave electric field, the toner carrying member 15 can perform the carrying of the toner T on the belt member 16 (FIG. 1).

Now, the description below will discuss the reason why it is preferable that the surface of the drive assistance roller 19 is covered with a member which is softer than the surface of the belt drive roller 18.

Figure 5:
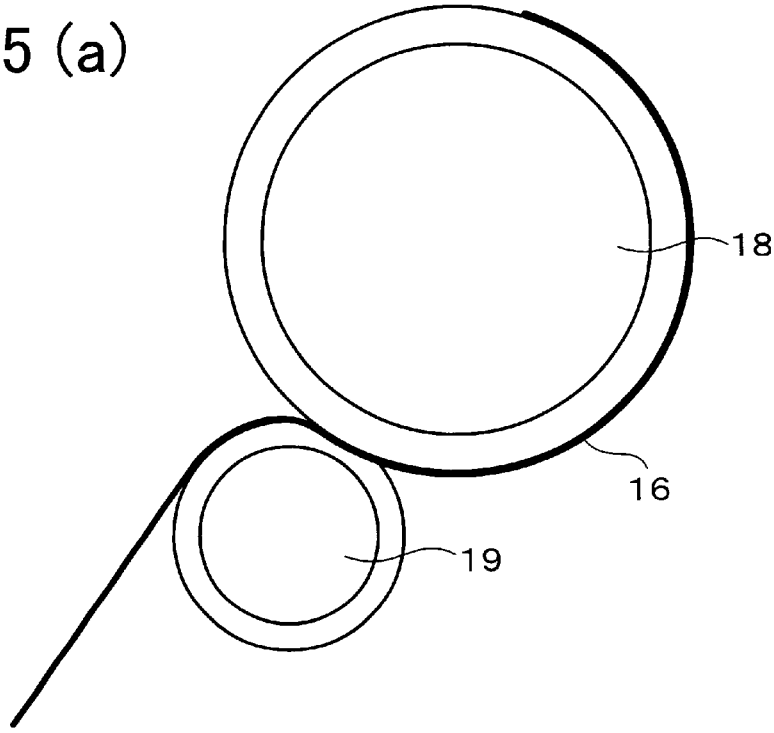
FIG. 5(*a*) is an explanatory view, illustrating a belt member on occasions when the surface of a drive assistance roller is softer than the surface of a belt drive roller, and FIG. 5(*b*) is an explanatory view, illustrating the belt member on occasions when the surface of the drive assistance roller is harder than the surface of the belt drive roller.
Figure 5:
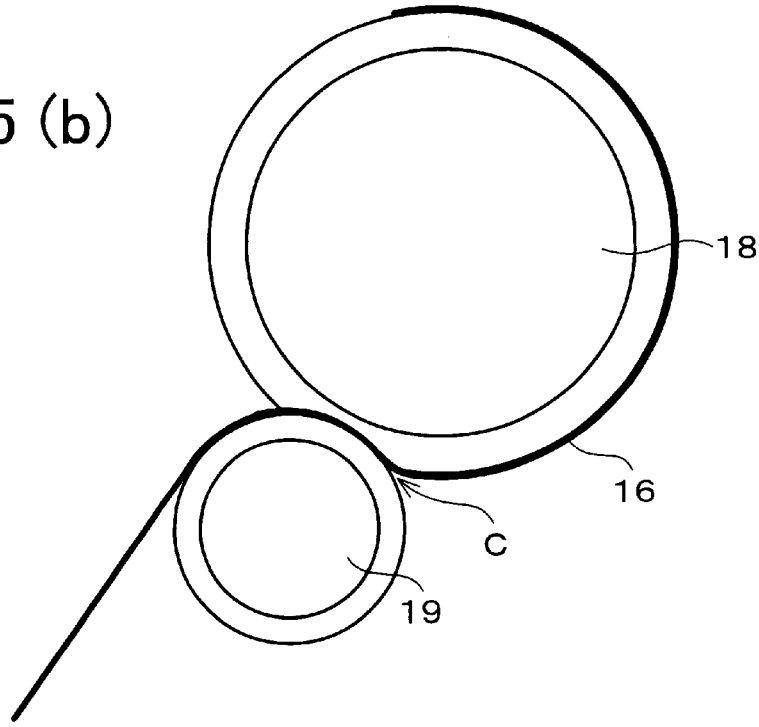

When the surface of the drive assistance roller 19 is covered with a member which is harder than the surface of the belt drive roller 18, as illustrated in FIG. 5(*b*), the belt member 16 is pushed onto the belt drive roller 18 at a portion indicated by an arrow C in the figure, where the belt member 16 starts to touch the drive assistance roller 19 on the occasion of rotating. Moreover, since the radius of the belt member roller 18 is longer than the radius of the drive assistance roller 19, the drive assistance roller 19 further pushes the belt member 16 onto the belt drive roller 18 so that the belt member 16 is bended at the foregoing portion. When the belt member is bended, wrinkles are caused thereon and this could hamper the carrying of the toner.

In contrast, when the surface of the drive assistance roller 19 is covered with a member softer than the surface of the belt drive roller 18, as FIG. 5(*a*) illustrates, the belt member 16 is pushed onto the drive assistance roller 19, at a portion between the drive assistance roller 19 and the belt drive roller 18. However, since the radius of the belt drive roller 18 is longer than the radius of the drive assistance roller 19, the belt member 16 is not pushed so much and hence not bended. That is, since the belt member 16 is not bended at the foregoing portion, it is possible to prevent the generation of wrinkles on the belt member 16. For this reason, it is preferable that the surface of the drive assistance roller 19 is covered with a member softer than the surface of the belt drive roller 18.

As described above, the developing device 5 in accordance with the present embodiment includes: the toner carrying member 15 for carrying the toner T towards the photosensitive drum 2 using the traveling wave electric field; the belt member 16 provided for covering the surface of the toner carrying member 15, the surface facing the photosensitive drum 2; and the belt drive roller 18 which is in touch with the belt member 16 so as to rotate the belt member 16 around the toner carrying member 15, and the developing device 5 is provided with the drive assistance roller 19 which sandwiches the belt member 16 with the belt drive roller 18.

That is to say, the developing device 5 in accordance with the present embodiment is arranged so that the toner carrying member 15 carries the toner T towards the photosensitive drum 2 using the traveling wave electric field. In this developing device 5 in accordance with the present embodiment, the toner T touches the toner carrying member 15, so that the surface of the toner carrying member 15 could be charged, and the toner T could adhere to the surface of the toner carrying member 15. When such problems as the charging of the toner carrying member 15, etc. occur, the carrying of the toner T could become unstable and the irregularity of density could be generated in a image acquired by developing an electrostatic latent image.

Thus, the developing device 5 in accordance with the present embodiment is provided with: the belt member 16 for covering the surface of the toner carrying member 15, the surface facing the photosensitive drum 2; and the belt drive roller 18 for touching the belt member 16 so as to rotate the belt member 16 around the toner carrying member 15.

Rotating the belt member 16 by the belt drive roller 18 enables the surface of the belt member 16, to which no electric potential has not been charged or the toner T has not adhered, to face the photosensitive drum 2. With this arrangement, it is possible to stably carry the toner T and develop an image without the irregularity of density.

Moreover, when the toner carrying member 15 is irregularly in touch with the belt member 16, the traveling wave electric field appearing on the surface of the belt member 16 from the toner carrying member 15 via the belt member 16 is irregular so that the toner T could be carried unstably. However, when the toner carrying member 15 is in absolute contact with the belt member 16, the frictional force between the toner carrying member 15 and the belt member 16 causes the rotating belt member to be under load conditions.

Thus, the developing device 5 in accordance with the present embodiment particularly includes a drive assistance roller 19 which sandwiches the belt member 16 with the belt drive roller 18.

That is to say, the belt member 16 is sandwiched between the belt drive roller 18 and the drive assistance roller 19. Thus, the contact pressure between the belt member 16 and the belt drive roller 18 is increased so that it is possible to rotate the belt member 16 with the force stronger than the load caused by the frictional force between the toner carrying member 15 and the belt member 16.

Further, since the driving force is enhanced by increasing the contact pressure between the belt member 16 and the belt drive roller 18, the belt drive roller 18 can rotate the belt member 16 even if the belt member 16 is at load conditions to some degree. Therefore, since it is unnecessary to lower the tension of the belt member 16 in order to decrease the load, the generation of unpleasant noise caused by the vibration of the belt member 16 can be prevented.

Moreover, since the driving force of the belt drive roller 18 can be enhanced by increasing the force of sandwiching the belt member 16 between the belt drive roller 18 and the drive assistance roller 19, it is unnecessary to increase the size of the belt drive roller 18 in order to increase the contact area between the belt drive roller 18 and the belt member 16. Thus, it is possible to acquire sufficient driving force using a small belt drive roller 18, so that the developing device 5 can be downsized and the costs thereof can be reduced.

The developing device 5 in accordance with the present embodiment is arranged in such a manner that the belt drive roller 18 is provided so as to touch the surface of the belt member 16, the surface being opposite to the surface for carrying the toner T.

That is to say, the surface of the belt member 16, for carrying the toner T, could be made dirty due to the adherence of the toner T. When the belt drive roller 18 is in contact with the dirty surface of the belt member 16, since the frictional resistance between the belt member 16 and the belt drive roller 18 is decreased compared to the case when the surface of the belt member 16 is not made dirty by the toner T, there is such a possibility that the driving force of the belt drive roller 18 is decreased. Especially, when the developing device has been used for a long period of time, contaminants are built up on the belt member 16 so that the driving force of the belt drive roller 18 with respect to the belt member 16 is significantly decreased, and this could cause an adverse effect on the rotation of the belt member 16.

On this account, in the present embodiment, the belt drive roller 18 is especially provided so as to touch the surface of the belt member 16, the surface being opposite to the surface for carrying the toner T.

That is to say, since the toner T does not adhere to the surface opposite to the surface for carrying the toner T, it is possible to maintain the frictional resistance between the belt member 16 and the belt drive roller 18 to be in the initial state.

With this arrangement, the decrease of the driving force of the belt drive roller 18 can be prevented and the belt member 16 can be stably rotated for a long period of time.

The developing device 5 in accordance with the present embodiment is arranged in such a manner that the belt drive roller 18 touches the belt member 16 and rotates at a peripheral velocity different from the peripheral velocity of the drive assistance roller 19.

With this arrangement, the belt drive roller 18 rotates at a peripheral velocity different from that of the drive assistance roller 19 so that the speed of feeding the belt member 16 by the belt drive roller 18 is different from the speed of feeding the belt member 16 by the drive assistance roller 19.

In order to cancel out this difference of speed, the belt member 16 is deformed, and hence either the contact pressure between the belt member 16 and the belt drive roller 18 or the contact pressure between the belt member 16 and the drive assistance roller 19 increases.

For this reason, either the driving force of the belt drive roller 18 or the driving force of the drive assistance roller 19 increases and hence it is possible to cause the belt member 16 to be in contact with the toner carrying member 15 further closely.

With this arrangement, it is possible to stably carry the toner T and develop an image without the irregularity of density.

The developing device 5 in accordance with the present embodiment is arranged in such a manner that the drive assistance roller 19 touches the belt member 16 and rotates at a peripheral velocity faster than the peripheral velocity of the belt drive roller 18.

According to this arrangement, the belt drive roller 18 feeds the surface of the belt member 16, the surface being opposite to the surface for carrying the toner T, at a speed faster than the speed at which the drive assistance roller 19 feeds the surface for carrying the toner T.

That is to say, the degree of deformation of the surface, for carrying the toner T, of the belt member 16 is higher than the degree of deformation of the surface opposite to the surface for carrying the toner T. For this reason, the surface for carrying the toner T becomes under tension so that the belt member 16 is in touch with the toner carrying member 15 more uniformly, and the contact pressure between the belt member 16 and the belt drive roller 18 increases.

With this arrangement, it is possible to stably carry the toner T, cause the drive of the belt to be more silent, and develop an image with stable density.

In the developing device 5 in accordance with the present embodiment, the friction coefficient between the belt member 16 and the belt drive roller 18 is higher than the friction coefficient between the belt member 16 and the drive assistance roller 19.

That is to say, when the drive assistance roller 19 is provide on the side of the surface, for carrying the toner T, of the belt member 16, the driving force, which is exerted from the drive assistance roller 19 to the belt member 16, varies in accordance with the condition of the adhesion of the toner T. On this occasion, the driving force exerted to the belt significantly varies when the frictional force between the drive assistance roller 19 and the belt member 16 is strong, so that stable drive of the belt could be difficult.

Thus, the present embodiment is especially arranged in such a manner that the friction coefficient between the belt member 16 and the belt drive roller 18 is higher than the friction coefficient between the belt member 16 and the drive assistance roller 19.

That is to say, it is possible to reduce the influence, of the condition of the adhesion of the toner T on the surface of the belt member 16, on the drive of the belt member 16 carried out by the drive assistance roller 19.

With this arrangement, it is possible to stably drive the belt member 16, carry the toner T, and develop an image with more stable density.

The developing device 5 in accordance with the present embodiment is arranged in such a manner that the portion at which the belt drive roller 18 touches the belt member 16 is composed of an elastic member.

According to this arrangement, the drive assistance roller 19 is in contact with the belt member 16 more closely so that it is possible to acquire more stable driving force of the belt.

On this account, it is possible to drive the belt member 16 more stably, carry the toner T stably, and develop an image with more stable density.

The developing device 5 in accordance with the present embodiment is arranged in such a manner that: (i) the belt drive roller 18 and the drive assistance roller 19 are both columns (cylinders) being in contact with the belt member 16 so as to rotate, (ii) the radius of the belt drive roller 18 is longer than the radius of the drive assistance roller 19, (iii) and the elastic member at which the drive assistance roller 19 is in contact with the belt member 16 is softer than the elastic member at which the belt drive roller 18 is in contact with the belt member 16.

That is to say, when the surface of the drive assistance roller 19 is covered with a member harder than the surface of the belt drive roller 18, the belt member 16 is pushed onto the belt drive roller 18 at a portion sandwiched between the belt drive roller 18 and the drive assistance roller 19. Moreover, when the belt drive roller 18 is column-shaped and the radius thereof is longer than the radius of the drive assistance roller 19 which is also column-shaped, the drive assistance roller 19 pushes the belt member 16 onto the belt drive roller 18 more strongly, and hence the belt member 16 is bended at the foregoing portion.

When the belt member is bended, wrinkles are caused on the belt member 16 and this could hamper the carrying of the toner T.

Thus, in the present embodiment, the elastic member at which the drive assistance roller 19 is in contact with the belt member 16 is softer than the elastic member at which the belt drive roller 18 is in contact with the belt member 16.

That is to say, the belt member 16 is pushed onto the drive assistance roller 19 at a portion sandwiched between the drive assistance roller 19 and the belt drive roller 18. However, since the radius of the belt drive roller 18 is longer than that of the drive assistance roller 19, the belt member 16 is not pushed so much and hence not bended.

With this arrangement, it is possible to prevent the generation of wrinkles on the belt member 16, and stably carry the toner T.

The developing device 5 in accordance with the present embodiment is arranged in such a manner that the surface(s) of the belt drive roller 18 and/or the drive assistance roller 19 is(are) made up of a conductive member.

That is to say, the belt member 16 necessarily transfers the traveling wave electric field, which is generated on the toner carrying member 15, to the surface of the belt member 16, so as to be made up of materials with a certain degree of resistance. For this reason, on occasions when the belt member 16 is in touch with any one of the toner T carried on the belt member 16, the toner carrying member 15, the belt drive roller 18, and the drive assistance roller 19, the belt member 16 is often charged excessively.

When the belt member 16 is excessively charged, the carrying of the toner T and the developing of an image cannot properly carried out so that it is necessary to discharge the belt member 16.

Thus, the present embodiment is particularly arranged so that the surface(s) of the belt drive roller 18 and/or the drive assistance roller 19 is(are) made up of a conductive member.

That is to say, at least either one of the surfaces of the respective belt drive roller 18 and the drive assistance roller 19 is conductive. For this reason, it is possible to discharge the belt member 16 by letting the electric potential charged in the belt member 16 flow to the belt drive roller 18 or the drive assistance roller 19.

With this arrangement, it is possible to discharge the belt member 16, carry the toner T more stably, and develop an image with stable density. Further, since it is unnecessary to additionally provide an arrangement exclusively for discharging the belt member 16, the developing device 5 can be downsized and provided at low cost.

In the developing device 5 in accordance with the present embodiment, it is possible to apply a voltage, whose polarity is opposite to the voltage supplied to the belt member 16, to the belt drive roller 18 and/or the drive assistance roller 19.

With this arrangement, it is possible to apply the voltage, whose polarity is opposite to the voltage supplied to the belt member 16, to at least either one of the belt drive roller 18 and the drive assistance roller 19. On this account, it is possible to discharge the belt member 16 more efficiently.

In the developing device 5 in accordance with the present embodiment, it is possible to apply alternating voltages to the belt drive roller 18 and/or the drive assistance roller 19.

That is to say, the belt member 16 necessarily transfers the traveling wave electric field, which is generated on the toner carrying member 15, to the surface of the belt member 16, so as to be made up of materials with a certain degree of resistance. Thus, either the contact resistance between the belt member 16 and the belt drive roller 18 or the contact resistance between the belt member 16 and the drive assistance roller 19 is high and hence simply applying a voltage having a predetermined value may not be enough to effectively discharge the surface of the belt member 16.

For this reason, the present embodiment is particularly arranged so that the belt drive roller 18 and/or the drive assistance roller 19 is(are) arranged so as to be capable of receiving an alternating voltage.

That is to say, it is possible to apply an alternating voltage to at least either the portion at which the belt member 16 is in contact with the belt drive roller 18 or the portion at which the belt member 16 is in contact with the drive assistance roller 19. Synchronizing the alternating voltage with the traveling wave electric field on the belt member 16 makes it possible to reduce the impedance of at least either the contact resistance between the belt member 16 and the belt drive roller 18 or the contact resistance between the belt member 16 and the drive assistance roller 19. With this arrangement, it is possible to discharge the belt member 16 more efficiently.

The developing device 5 in accordance with the present embodiment is arranged in such a manner that a portion of the belt member 16, which is sandwiched between the belt drive roller 18 and the drive assistance roller 19, is shorter than the width of the belt member 16.

In order to discharge the belt member 16 effectively, it is preferable that the resistance of the belt drive roller 18 and the drive assistance roller 19 are low. However, when both of these resistances are low, electric charges could be leaked on the occasion of the contact of the belt drive roller 18 with the drive assistance roller 19. On this occasion, the electric field between the belt member 16 and the belt drive roller 18 or the electric field between the belt member 16 and the drive assistance roller 19 could be weakened so that the discharging is not effectively carried out.

Thus, the present embodiment is specifically arranged in such a manner that the length of the portion of the belt member 16, the portion being sandwiched between the belt drive roller 18 and the drive assistance roller 19, is shorter than the width of the belt member 16.

With this arrangement, the belt drive roller 18 is not in contact with the drive assistance roller 19 and hence the leakage of the electric charges between the belt drive roller 18 and the drive assistance roller 19 does not occur.

On this account, the electric field generated either between the belt drive roller 18 and the belt member 16 or between the drive assistance roller 19 and the belt member 16 does not weaken so that it is possible to discharge the belt member 16 more effectively.

In the developing device 5 in accordance with the present embodiment, the volume resistivity of the belt member 16 is within the range between $1\times10^{8}$ Ω.cm and $1\times10^{16}$ Ω.cm.

That is to say, when the volume resistivity of the belt member 16 is too high, there may be cases where the belt member 16 is not sufficiently discharged. In contrast, when the volume resistivity of the belt member 16 is too low, there may be cases where the traveling wave electric field generated on the toner carrying member 15 does not adequately appear on the belt member 16 so that it is not possible to stably carry the toner T.

As a result of diligent researches conducted by the inventors of the present invention, it has been found that it is possible to stably carry the toner T on the belt member 16 and sufficiently discharge the belt member 16, when the volume resistivity of the belt member 16 falls within the aforementioned range.

Thus, it is possible to stably carry the toner T on the belt member 16 and sufficiently discharge the belt member 16.

Embodiment 2

Referring to figures, the following description will discuss another embodiment of the present invention. By the way, members having the same functions as those described in Embodiment 1 are given the same numbers, so that the descriptions are omitted for the sake of convenience.

Figure 6:
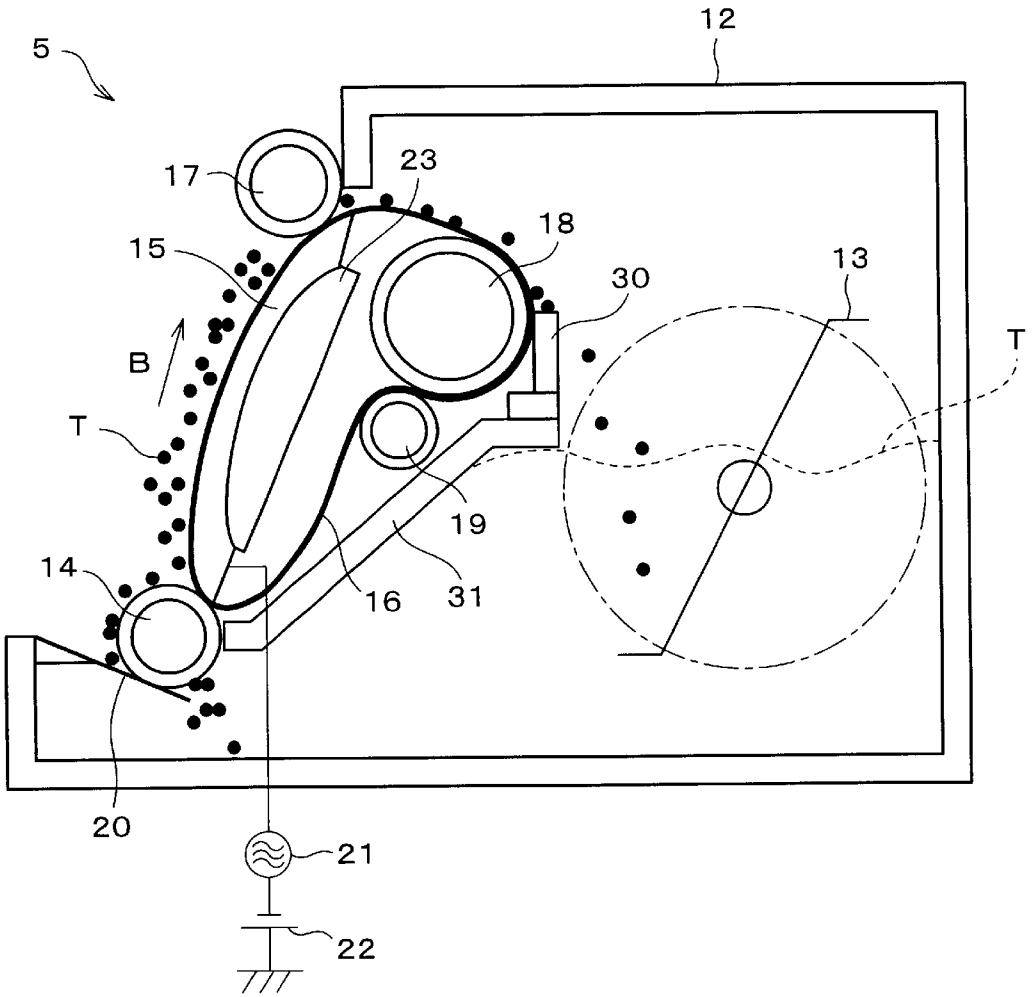
FIG. 6 is a schematic view, illustrating another embodiment of the developing device in accordance with the present invention.

A developing device 5 in accordance with the present embodiment is, as illustrated in FIG. 6, arranged identically with the developing device 5 of the Embodiment 1, except that a cleaning blade (cleaning means) 30 and a dividing wall 31 are provided therein. For this reason, the description below relates to these members.

The cleaning blade 30, provided for scraping toner T adhered to the surface of a belt member 16, is fixed to a housing 12 so as to touch a belt drive roller 18 via the belt member 16. The toner T scraped off by the cleaning blade 30 is accumulated in the housing 12, and recycled for developing an electrostatic latent image.

The cleaning blade 30 is composed of materials such as stainless steel (SUS), nickel-plated iron, urethane, and silicon rubber.

The dividing wall 31, provided for preventing the toner T accumulated in the housing 12 from adhering to the belt member 16, is located under the belt member 16 (on the side opposite to the surface facing a photosensitive drum 2) in order to separate the belt member 12 from the toner T accumulated in the housing 12. The dividing wall 31 is provided to be adjacent to the cleaning blade 30.

In this manner, the developing device 5 in accordance with the present embodiment is equipped with the cleaning blade 30 for removing the toner T on the belt member 16.

As in the foregoing description, the toner T adheres to the surface of the belt member 16, and the toner T may be solidified on the belt member 16 if the adhered toner T is set aside. This may result in problems such as the belt member 16 cannot carry the toner T properly and an image is developed without appropriate density.

For this reason, the cleaning blade 30 for removing the toner T on the belt member 16 is specifically provided in the present embodiment.

Thus, the toner T on the belt member 16 is removed by the cleaning blade 30.

With this arrangement, it is possible to stably carry the toner T and develop an image with appropriate density.

Moreover, in the developing device 5 of the present embodiment, the cleaning blade 30 is provided on the upstream side of the rotative direction of the belt member 16, with respect to the drive assistance roller 19.

As described above, the toner T adheres to the surface of the belt member 16. According to the condition of the adhered toner T, the driving force for the belt member 16 which is supported by the drive assistance roller 19 may be fluctuated.

Thus, in the present embodiment, the cleaning blade 30 is particularly provided on the upstream side of the rotative direction of the belt member 16, with respect to the drive assistance roller 19, and hence the drive assistance roller 19 is in touch with the surface of the belt member 16 which is always without the toner T.

In other words, the contact condition between the drive assistance roller 19 and the belt member 16 is kept consistent so as not to be influenced by the toner T adhered to the surface of the belt member 16.

For this reason, it is possible to drive the belt member 16 in a more stable manner and carry the toner T more effectively, so that an image with an appropriate density can be developed.

Embodiment 3

Regarding a further embodiment of the present embodiment, an explanation in reference to figures is provided as below. By the way, members having the same functions as those described in Embodiments 1 and 2 are given the same numbers, so that the descriptions are omitted for the sake of convenience.

Figure 7:
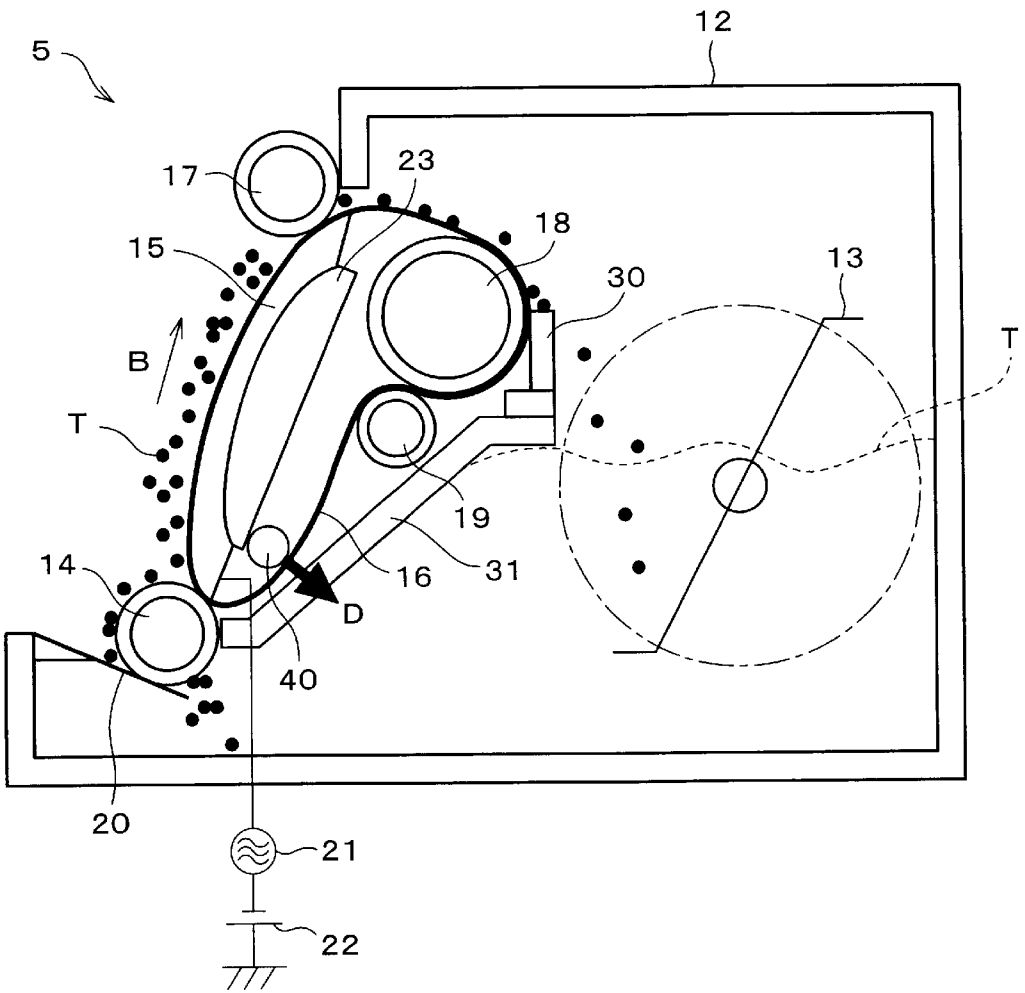
FIG. 7 is a schematic view, illustrating a further embodiment of the developing device in accordance with the present invention.

A developing device 5 in accordance with the present embodiment is, as illustrated in FIG. 7, arranged identically with the developing device 5 of the Embodiment 2, except that a tension control roller (tension control means) 40 and pressing means (not illustrated) are additionally provided. For this reason, the description below relates to these members.

The tension control roller 40 for imparting tension to a belt member 16 is in touch with the inner surface of the belt member 16 and provided on the downstream side of the rotative direction of the belt member 16, with respect to the drive assistance roller 19.

As the tension control roller 40, it is possible to adopt a metal roller made of materials such as stainless steel (SUS) and iron. The surface of the tension control roller 40 is covered with an elastic member made of materials such as rubber, film, and sponge. The tension control roller 40 may be shaped like a plate or a prism.

The tension control roller 40 is provided so as to be rotatable with respect to the housing 12, and hence it is possible to reduce the load of the belt member 16, which is caused by the friction between the tension control roller 40 and the belt member 16. Here, it is noted that even if the tension control roller 40 is provided so as not to be rotatable with respect to the housing 12, it is possible to reduce the load by providing a member with small friction coefficient in a space between the belt member 16 and the tension control roller 40.

The drive of the tension control roller 40 may be carried out: in accordance with the rotation of the belt member 16; by being connected to the belt drive roller 18 using a gear (not illustrated); being connected to the belt drive roller 18 using a pulley and a belt (both not illustrated); or using a driver other than the belt drive roller 18.

The pressing means is provided for pressing the tension control roller 40, and as the pressing means, a leaf spring or a coil spring can be used. The pressing means presses the tension control roller 40 in the direction indicated by an arrow D in FIG. 7, i.e. in the direction away from the belt member 16. It is possible to control the tension of the belt member 16 by changing the force of the pressing means pressing the tension control roller 40.

As described above, the developing device 5 in accordance with the present embodiment is provided with the tension control roller 40 which imparts tension to the belt member 16 and enables to control the tension.

That is to say, on the occasion of long-term use, the belt member 16 may be stretched due to the tension imparted to the same, and the peripheral length of the belt member 16 is not identical in each of the developing devices due to the variations on the occasion of manufacturing the same.

In this case, the driving force of the belt member 16 is varied and this causes the belt member 16 to be not uniformly in contact with the toner carrying member 15, so that the toner T may not be stably carried and a noise is generated because of the vibration of the belt member 16.

Thus, in the present embodiment, the tension control roller 40 is provided for imparting tension to the belt member 16 and controlling the tension.

That is to say, even if the belt member 16 is stretched, it is possible to keep the tension imparted to the belt member 16 consistent by increasing the tension by the tension control roller 40. Moreover, even if the peripheral lengths of the respective belt members 16 of the developing devices are not uniform, the tension control roller 40 enables to impart appropriate tension to the belt member 16.

With this arrangement, it is possible to stably drive the belt member 16 and carry the toner T more stably, so that an image with an appropriate density can be developed.

The developing device 5 in accordance with the present embodiment is arranged in such a manner that the tension control roller 40 is in touch with the surface of the belt member 16, the surface being opposite to the surface for carrying the toner T.

According to the arrangement above, the tension control roller 40 is in touch with the surface of the belt member 16, the surface being opposite to the surface for carrying the toner T.

That is to say, since the toner T does not adhere to a portion where the tension control roller 40 is in touch with the belt member 16, the tension control roller 40 is always in touch with the belt member 16 in a consistent manner, and hence consistent tension is imparted to the belt member 16. With this arrangement, it is possible to drive the belt member 16 more stably.

It is noted that instead of the developing devices of the present invention described above, a developing device described below may be adopted.

That is, a developing device of the present invention, which is for developing an electrostatic latent image formed on an image supporter, may comprise: developing agent carrying means which forms a traveling wave electric field by applying multiphase voltages to a plurality of electrodes provided on a base material at a regular interval, so as to carry a developing agent towards the image supporter; a belt member which covers the surface of the developing agent carrying means and is driven at creeping speed; at least one drive member for driving the belt member, which is in touch with the belt member; and a drive assistance member which is in touch with the drive member via the belt member.

In this developing device, the drive member may be provided so as to face the surface of the belt member, the surface being opposite to the surface for carrying the developing agent.

Moreover, the driving speed of the drive member may be different from the driving speed of the drive assistance member, so that the drive peripheral velocity of the drive member is preferably arranged so as to be faster than the drive peripheral velocity of the drive assistance member.

In the developing device with the foregoing arrangement, provided that the friction coefficient between the belt member and the drive member is $\mu 1$ and the friction coefficient between the belt member and the drive assistance member is $\mu 2$, the relationship between $\mu 1$ and $\mu 2$ may be $\mu 1 > \mu 2$.

Moreover, a portion of the drive assistance member, where the drive assistance member is in touch with the belt member, may be made of an elastic material, and the drive assistance member is preferably made of a material softer than the drive member.

Further, the developing device with the foregoing arrangement can be provided with a cleaning member for removing a developing agent on the belt member, and this cleaning member is preferably provided on the upstream of the drive assistance member, with respect to the rotative direction of the belt member.

Moreover, there can be provided with a belt tension control member which is in touch with the surface of the belt member, the surface being opposite to the surface for carrying the developing agent.

Further, at least either one of the drive assistance member and the drive member may be conductive.

Moreover, at least either one of the drive assistance member and the drive member may be applied an arbitrary voltage or an arbitrary alternating voltage.

In the developing device with the foregoing arrangement, the length of at least either one of the drive assistance member and the drive member may be shorter than the width of the belt member.

The volume resistivity of the belt member is preferably within the range between $1\times10^{8}$ Ω.cm and $1\times10^{16}$ Ω.cm.

Moreover, an image forming device in accordance with the present invention may comprise a developing device with any one of the foregoing arrangements.

It is noted that the developing device in accordance with the present invention can be applied for: an ion-flow image forming device in which an electrostatic latent image is formed directly on a dielectric substance; and a toner-jet image forming device in which an electrostatic image is formed in a space by applying an arbitrary voltage to an electrode with a plurality of openings, so as to cause the developing agent to fly to a recording medium.

Incidentally, Japanese Laid-Open Patent Application No. 6-308813/1994 (Tokukaihei 6-308813; published on Nov. 4, 1994) discloses an invention to provide an elastic roller on the inner surface of a belt member in order to stabilize the tension of the belt member. In the following description, the difference between a developing device of this invention and the developing device of the present invention will be discussed.

The developing device of the present invention is provided with drive assistance means so that a belt member is sandwiched between the drive assistance means and drive means. In contrast, the developing device of the foregoing publication is provided with an elastic roller on the inner surface of a belt member and does not include a member equivalent to the drive assistance means of the present invention. On this account, the arrangement of the developing device of the present invention is clearly different from the arrangement of the developing device disclosed by the foregoing publication.

Moreover, while the developing device in accordance with the present invention is provided with developing agent carrying means which is for generating a traveling wave electric field for carrying toner and provided so as to face the inner surface of the belt member, the developing device of the foregoing publication does not include this developing agent carrying means for generating a traveling wave electric field. Thus, the present invention is arranged so as to be clearly different from the invention disclosed by the foregoing publication.

Further, the belt member of the developing device in accordance with the present invention is provided for preventing (i) the developing agent carrying means from being charged and (ii) the developing agent from adhering to the surface of the developing agent carrying means. In the meantime, the belt member of the developing device of the foregoing publication is provided for carrying a developing agent to an image supporter. On this account, in terms of the effects, the belt member of the developing device in accordance with the present invention is evidently different from the belt member of the developing device in accordance with the forging publication.

As described above, the developing device in accordance with the present invention is different from the developing device in accordance with the invention disclosed by the foregoing publication, in terms of the arrangement and effects.

EXAMPLE

Regarding the developing device in accordance with the present invention, the relationship between the toner carrying characteristics and the discharging efficiency of a belt member with respect to the volume resistivity of the belt member was examined as below. That is, in the present example, the volume resistivity of a belt member 16 was varied within the range from $1\times10^{6}$ Ω.cm to $1\times10^{17}$ Ω.cm and the toner carrying characteristics and the discharging efficiency of the belt member 16 were evaluated on a one-to-four scale. Then according to the result of this, it was comprehensively evaluated that to what extent the volume resistivity of the belt member 16 can be varied.

More specifically, the pitch between electrodes 27 of a toner carrying member 15 was set so as to be around 250 μm and the widths of the respective electrodes 27 were set so as to be around 120 μm, and a voltage whose frequency is 1 kHz and whose voltage value is 0±500V was applied to the electrodes 27. Also, a belt roller 18 was grounded and a voltage within the range of 500–1000 Hz and a voltage within the range of 0±100V to 0±500V are applied to a drive assistance roller 19 so that discharging was carried out.

The results of evaluations with the foregoing conditions are illustrated in Table. 1. Evaluation Standards 1–3 in Table. 1 are as follows.

In Evaluation Standard 1, respective symbols indicate as X: small amount of carrying and large amount of adherence, Δ: either one of the amount of carrying and the amount of adherence is inadequate, ○: both the amount of carrying and the amount of adherence are proper, and ◎: both the amount of carrying and the amount of adherence are excellent.

In Evaluation Standard 2, respective symbols indicate as X: discharging is not properly carried out, Δ: discharging is not properly carried out in some parts, ○: discharging is properly carried out, and ◎: discharging is excellently carried out.

In Evaluation Standard 3, respective symbols indicate as X: defective, Δ: not good, ○: good, and ◎: excellent.

TABLE 1

| BELT VOLUME RESISTIVITY ρ (Ω · cm) | TONER CARRYING CHARACTER-ISTICS (EVALUATION STANDARD 1) | DISCHARGING EFFICIENCY OF BELT MEMBER (EVALUATION STANDARD 2) | COMPLEHEN-SIVE EVALUATION (EVALUATION STANDARD 3) |
|---|---|---|---|
| $1\times10^{6}$ | X-Δ | ◎ | X-Δ |
| $1\times10^{8}$ | Δ | ◎ | ○ |
| $1\times10^{10}$ | ○ | ◎ | ◎ |
| $1\times10^{12}$ | ◎ | ○ | ◎ |
| $1\times10^{14}$ | ◎ | ○ | ◎ |
| $1\times10^{16}$ | ◎ | Δ | ○ |
| $1\times10^{17}$ | ◎-X | X | X-Δ |

As illustrated in Table. 1, when the volume resistivity of a belt member 16 was low, the belt member 16 was scarcely charged so that discharging efficiency was excellent. However, since low volume resistivity results in a weak traveling electric field, the traveling wave electric field did not reach the surface of the belt member 16 and hence the amount of carried toner was insufficient. Moreover, since the force to carry toner T was not enough, the toner adhered to the surface of the belt member.

In contrast, when the volume resistivity of the belt member 16 was high, the traveling wave electric field was strong and the toner carrying characteristics were good in early stages of the developing process. However, due to the contact with the toner T and the friction against the surface of a toner carrying member 15, the belt member 16 became susceptible to charging so that the toner carrying characteristics of the belt member 16 gradually worsened. In this manner, it has been proved that, when the belt member 16 is charged, even if the discharging effectiveness is increased by a drive assistance roller 19 (i.e. a frequency and an off-peak voltage of an alternating voltage to be applied are increased), it is not possible to efficiently carry out the discharging.

To solve the foregoing problems, the developing device in accordance with the present invention is characterized by comprising: developing agent carrying means for carrying a developing agent towards an image supporter, using an electric field in which distribution of electric potentials varies in a manner of traveling waves having a predetermined direction of movement; a belt member which is provided so as to cover a surface of the developing agent carrying means, the surface facing the image supporter; drive means which is in touch with the belt member, for rotating the belt member around the developing agent carrying means; and drive assistance means which is provided so as to sandwich the belt member with the drive means.

That is, the developing device of the present invention is arranged in such a manner that the developing agent carrying means carries the developing agent towards the image supporter using the electric field (traveling wave electric field) in which distribution of electric potentials varies in a manner of traveling waves having a predetermined direction of movement. In the developing device in accordance with the present invention, the surface of the developing agent carrying means could be charged due to the contact with the developing agent, and the developing agent could adhere to the developing agent carrying means. When such problems as the charging of the developing agent carrying means occur, there may be cases where the developing agent is not stably carried and the density of an image obtained by developing an electrostatic latent image is irregular.

Thus, the developing device of the present invention comprises the belt member provided so as to cover the surface of the developing agent carrying means, the surface facing the image supporter, and the drive means which is in touch with the belt member so as to rotate the belt member around the developing agent carrying member.

Rotating the belt member by the drive means makes it possible to cause the surface of the belt member, which is not charged or to which no developing agent adheres, to face the image supporter. With this arrangement, it is possible to stably carry the developing agent and to develop an image with little irregularity of density.

When the developing agent carrying means is irregularly in touch with the belt member, the traveling wave electric field appearing on the surface of the belt member, which is extended from the developing agent carrying means via the belt member, is also irregular so that it could be impossible to carry the developing agent stably. In the meantime, when the developing agent carrying means is uniformly in touch with the belt member, the frictional force between the developing agent carrying member and the belt member causes the rotating belt member to be under load conditions.

For this reason, the developing device in accordance with the present invention particularly includes the drive assistance means provided so as to sandwich the belt member with the drive means.

In other words, the belt means is sandwiched between the drive means and the drive assistance means. With this arrangement, the contact pressure between the drive means the belt member is increased so that it is possible to rotate the belt member with the force stronger than the load caused by the frictional force between the developing agent carrying means and the belt member.

Moreover, since the driving force is enhanced by increasing the contact pressure between the drive means and the belt member, the drive means can rotate the belt member even if the belt member is at load conditions to some degree. Therefore, since it is unnecessary to lower the tension of the belt member in order to decrease the load, the generation of unpleasant noise caused by the vibration of the belt member can be prevented and hence the quietness of the device can be improved.

Moreover, in the foregoing arrangement, since the driving force of the drive means can be enhanced by increasing the force of sandwiching the belt member between the drive means and the drive assistance means, it is unnecessary to increase the size of the drive means in order to increase the contact area between the drive means and the belt member. Thus, it is possible to acquire sufficient driving force using small drive means, so that the developing device can be downsized and the costs thereof can be reduced.

To solve the foregoing problems, the developing device in accordance with the present invention is characterized in that the drive means is provided so as to be in touch with a surface of the belt member, the surface being opposite to a surface for carrying the developing agent.

That is to say, the surface of the belt member, for carrying the developing agent, could be made dirty due to the adherence of the developing agent. When the drive means is in contact with the dirty surface of the belt member, since the frictional resistance between the belt member and the drive means is decreased compared to the case when the surface of the belt member is not made dirty by the developing agent, there is such a possibility that the driving force of the drive means is decreased. Especially, when the developing device has been used for a long period of time, contaminants are built up on the belt member so that the driving force of the drive means with respect to the belt member is significantly decreased, and this could cause an adverse effect on the rotation of the belt member.

On this account, in the present invention, the drive means is especially provided so as to touch the surface of the belt member, the surface being opposite to the surface for carrying the developing agent.

That is to say, since the developing agent does not adhere to the surface opposite to the surface for carrying the developing agent, it is possible to maintain the frictional resistance between the belt member and the drive means to be in the initial state.

Thus, in addition to the effects of the developing device with the foregoing arrangement, it is possible to prevent the decrease of the driving force of the drive means and stably rotates the belt member even when the developing device is used for a long period of time.

To solve the foregoing problems, the developing device in accordance with the present invention is characterized in that the drive means and the drive assistance means are in touch with the belt member so as to rotate at different peripheral velocities.

According to this arrangement, the drive means rotates at a peripheral velocity different from that of the drive assistance means so that the speed of feeding the belt member by the drive means is different from the speed of feeding the belt member by the drive assistance means.

In order to cancel out this difference of speed, the belt member is deformed, and hence either the contact pressure between the belt member and the drive means or the contact pressure between the belt member and the drive assistance means increases.

For this reason, either the driving force of the drive means or the driving force of the drive assistance means increases and hence it is possible to cause the belt member to be in contact with the developing agent carrying means further closely.

Thus, in addition to the effects of the developing device with the foregoing arrangement, it is possible to stably carry the developing agent and develop an image without the irregularity of density.

To solve the foregoing problems, the developing device in accordance with the present invention is characterized in that the drive assistance means is in touch with the belt member so as to rotate at a peripheral velocity higher than a peripheral velocity of the drive means.

According to this arrangement, the speed of feeding the belt member by the drive means is slower than the speed of feeding the belt member by the drive assistance means.

That is to say, the degree of deformation of the surface, for carrying the developing agent, of the belt member is higher than the degree of deformation of the surface opposite to the surface for carrying the developing agent. For this reason, the surface for carrying the developing agent becomes under tension so that the belt member is in touch with the developing agent carrying means more uniformly, and the contact pressure between the belt member and the drive means increases.

Thus, in addition to the effects of the developing device with the foregoing arrangement, it is possible to stably carry the developing agent, cause the drive of the belt to be more silent, and develop an image with stable density.

To solve the foregoing problems, the developing device in accordance with the present invention is characterized in that friction coefficient between the belt member and the drive means is higher than friction coefficient between the belt member and the drive assistance means.

That is to say, when the drive assistance means is provide on the side of the surface, for carrying the developing agent, of the belt member, the driving force, which is exerted from the drive assistance means to the belt member, varies in accordance with the condition of the adhesion of the developing agent. On this occasion, the driving force exerted to the belt significantly varies when the frictional force between the drive assistance means and the belt member is strong, so that stable drive of the belt could be difficult.

Thus, the present invention is especially arranged in such a manner that the friction coefficient between the belt member and the drive means is higher than the friction coefficient between the belt member and the drive assistance means.

That is to say, it is possible to reduce the influence, of the condition of the adhesion of the developing agent on the surface of the belt member, on the drive of the belt member carried out by the drive assistance means.

With this arrangement, it is possible to stably drive the belt member, carry the developing agent, and develop an image with more stable density.

To solve the foregoing problems, the developing means in accordance with the present invention is characterized in that a portion of the drive means, where the drive means is in touch with the belt member, is composed of an elastic member.

According to this arrangement, the drive means is in contact with the belt member more closely so that it is possible to stably drive the belt member.

On this account, in addition to the effects of the developing device with the foregoing arrangement, it is possible to stably carry the developing agent and develop an image with stable density.

To solve the foregoing problems, the developing device in accordance with the present invention is characterized in that a portion of the drive assistance means, where the drive assistance means is in touch with the belt member, is composed of an elastic member.

According to this arrangement, the drive assistance means is in contact with the belt member more closely so that it is possible to stably drive the belt member.

On this account, in addition to the effects of the developing device with the foregoing arrangement, it is possible to stably carry the developing agent and develop an image with stable density.

To solve the foregoing problems, the developing device in accordance with the present invention is characterized in that the drive means and the drive assistance means are respective columns which are in touch with the belt member so as to rotate, a radius of the drive means is longer than a radius of the drive assistance means, and the elastic member located at the portion where the drive assistance means is in touch with the belt member is softer than the elastic member located at the portion where the drive means is in touch with the belt member.

That is to say, when the surface of the drive assistance means is covered with a member harder than the surface of the drive means, the belt member is pushed onto the drive means at a portion sandwiched between the drive means and the drive assistance means. Moreover, when the drive means is column-shaped and the radius thereof is longer than the radius of the drive assistance means which is also column-shaped, the drive assistance means pushes the belt member onto the drive means more strongly, and hence the belt member is bended at the foregoing portion.

When the belt member is bended, wrinkles are caused on the belt member and this could hamper the carrying of the developing agent.

Thus, in the present invention, the elastic member at which the drive assistance means is in contact with the belt member is softer than the elastic member at which the drive means is in contact with the belt member.

That is to say, the belt member is pushed onto the drive assistance means at a portion sandwiched between the drive assistance means and the drive means. However, since the radius of the drive means is longer than that of the drive assistance means, the belt member is not pushed so much and hence not bended.

Thus, in addition to the effects of the developing device with the foregoing arrangement, it is possible to prevent the generation of wrinkles on the belt member, and stably carry the developing agent.

To solve the foregoing problems, the developing device in accordance with the present invention is characterized in that at least either one of the drive means and the drive assistance means has a surface composed of a conductive member.

That is to say, the belt member necessarily transfers the traveling wave electric field, which is generated on the developing agent carrying means, to the surface of the belt member, so as to be made up of materials with a certain degree of resistance. For this reason, on occasions when the belt member is in touch with any one of the developing agent carried on the belt member, the developing agent carrying means, the drive means, and the drive assistance means, the belt member is often charged excessively.

When the belt member is excessively charged, the carrying of the developing agent and the developing of an image cannot properly carried out so that it is necessary to discharge the belt member.

Thus, the present invention is particularly arranged so that the surface(s) of the drive means and/or the drive assistance means is(are) made up of a conductive member.

That is to say, at least either one of the surfaces of the respective drive means and the drive assistance means is conductive. For this reason, it is possible to discharge the belt member by letting the electric potential charged in the belt member flow to the drive means or the drive assistance means.

Thus, in addition to the effects of the developing device with the foregoing arrangement, it is possible to discharge the belt member, carry the developing agent more stably, and develop an image with stable density. Further, since it is unnecessary to additionally provide an arrangement exclusively for discharging the belt member, the developing device can be downsized and provided at low cost.

To solve the foregoing problems, the developing device in accordance with the present invention is characterized in that at least either one of the drive means and the drive assistance means can be applied a voltage opposite to a voltage of the belt member.

According to this arrangement, a voltage opposite to a voltage of the belt member can be applied to the drive means and/or the drive assistance means.

Thus, in addition to the effects of the developing device with the foregoing arrangement, it is possible to discharge the belt member in a more efficient manner.

To solve the foregoing problems, the developing device in accordance with the present invention is characterized in that at least either one of the drive means and the drive assistance means can be applied an alternating voltage.

That is to say, the belt member necessarily transfers the traveling wave electric field, which is generated on the developing agent carrying means, to the surface of the belt member, so as to be made up of materials with a certain degree of resistance. Thus, either the contact resistance between the belt member and the drive means or the contact resistance between the belt member and the drive assistance means is high and hence simply applying a voltage having a predetermined value may not be enough to effectively discharge the surface of the belt member.

For this reason, the present invention is particularly arranged so that the drive means and/or the drive assistance means is(are) arranged so as to be capable of receiving an alternating voltage.

That is to say, it is possible to apply an alternating voltage to at least either the portion at which the belt member is in contact with the drive means or the portion at which the belt member is in contact with the drive assistance means. Synchronizing the alternating voltage with the traveling wave electric field on the belt member makes it possible to reduce the impedance of at least either the contact resistance between the belt member and the drive means or the contact resistance between the belt member and the drive assistance means.

Thus, in addition to the effects of the developing device with the foregoing arrangement, it is possible to discharge the belt member in a more efficiently.

To solve the foregoing problems, the developing device in accordance with the present invention is characterized in that a portion of the belt member, the portion being sandwiched between the drive means and the drive assistance means, is shorter than a width of the belt member.

That is, in order to discharge the belt member effectively, it is preferable that the resistances of the drive means and the drive assistance means are low. However, when both of these resistances are low, electric charges could be leaked on the occasion of the contact of the drive means with the drive assistance means. On this occasion, the electric field between the belt member and the drive means or the electric field between the belt member and the drive assistance means could be weakened so that the discharging is not effectively carried out.

Thus, the present invention is specifically arranged in such a manner that the length of the portion of the belt member, the portion being sandwiched between the drive means and the drive assistance means, is shorter than the width of the belt member.

With this arrangement, the drive means is not in contact with the drive assistance means and hence the leakage of the electric charges between the drive means and the drive assistance means does not occur.

Thus, in addition to the effects of the developing device with the foregoing arrangement, the electric field generated either between the drive means and the belt member or between the drive assistance means and the belt member does not weaken so that it is possible to discharge the belt member more effectively.

To solve the foregoing problems, the developing device in accordance with the present invention is characterized in that volume resistivity of the belt member is within a range of $1\times10^{8}$ Ω.cm to $1\times10^{16}$ Ω.cm.

That is to say, when the volume resistivity of the belt member is too high, there may be cases where the belt member is not sufficiently discharged. In contrast, when the volume resistivity of the belt member is too low, there may be cases where the traveling wave electric field generated on the developing agent carrying means does not adequately appear on the belt member so that it is not possible to stably carry the developing agent.

As a result of diligent researches conducted by the inventors of the present invention, it has been found that it is possible to stably carry the developing agent on the belt member and sufficiently discharge the belt member, when the volume resistivity of the belt member falls within the aforementioned range.

Thus, in addition to the effects of the developing device with the foregoing arrangement, it is possible to stably carry the developing agent on the belt member and sufficiently discharge the belt member.

To solve the foregoing problems, the developing device in accordance with the present invention is characterized by further comprising cleaning means for removing the developing agent on the belt member.

As in the foregoing description, the developing agent adheres to the surface of the belt member, and the developing agent may be solidified on the belt member if the adhered developing agent is set aside. This may result in problems such as the belt member cannot carry the developing agent properly and an image is developed without appropriate density.

For this reason, the cleaning means for removing the developing agent on the belt member is specifically provided in the present invention, and hence the developing agent on the belt member is removed by the cleaning means.

Thus, in addition to the effects of the developing device with the foregoing arrangement, it is possible to stably carry the developing agent and develop an image with appropriate density.

To solve the foregoing problems, the developing device in accordance with the present invention is characterized in that the cleaning means is provided on an upstream side of a rotative direction of the belt member, with respect to the drive assistance means.

As described above, the developing agent adheres to the surface of the belt member. According to the condition of the adhered developing agent, the driving force for the belt member which is supported by the drive assistance means may be fluctuated.

Thus, in the present invention, the cleaning means is particularly provided on the upstream side of the rotative direction of the belt member, with respect to the drive assistance means, and hence the drive assistance means is in touch with the surface of the belt member which is always without the developing agent.

In other words, the contact condition between the drive assistance means and the belt member is kept consistent so as not to be influenced by the developing agent adhered to the surface of the belt member.

Thus, in addition to the effects of the developing device with the foregoing arrangement, it is possible to drive the belt member in a more stable manner and carry the developing agent more effectively, so that an image with an appropriate density can be developed.

To solve the foregoing problems, the developing device in accordance with the present invention is characterized by further comprising tension control means for imparting tension to the belt member and controlling the tension.

That is to say, on the occasion of long-term use, the belt member may be stretched due to the tension imparted to the same, and the peripheral length of the belt member is not identical in each of the developing devices due to the variations on the occasion of manufacturing the same.

In this case, the driving force of the belt member is varied and this causes the belt member to be not uniformly in contact with the toner carrying member 15, so that the developing agent may not be stably carried and a noise is generated because of the vibration of the belt member.

Thus, in the present invention, the tension control means is provided for imparting tension to the belt member and controlling the tension.

That is to say, even if the belt member is stretched, it is possible to keep the tension imparted to the belt member consistent by increasing the tension by the tension control means. Moreover, even if the peripheral lengths of the respective belt members of the developing devices are not uniform, the tension control means enables to impart appropriate tension to the belt member.

Thus, in addition to the effects of the developing device with the foregoing arrangement, it is possible to stably drive the belt member and carry the developing agent more stably, so that an image with an appropriate density can be developed.

To solve the foregoing problems, the developing device in accordance with the present invention is characterized in that the tension control means is in touch with a surface of the belt member, the surface being opposite to a surface for carrying the developing agent.

According to the arrangement above, the tension control means is in touch with the surface of the belt member, the surface being opposite to the surface for carrying the developing agent.

That is to say, since the developing agent does not adhere to a portion where the tension control means is in touch with the belt member, the tension control means is always in touch with the belt member in a consistent manner, and hence consistent tension is imparted to the belt member.

Thus, in addition to the effects of the developing device with the foregoing arrangement, it is possible to drive the belt member more stably.

To solve the foregoing problems, the image forming device in accordance with the present invention is characterized by comprising a developing device with any one of the above-mentioned arrangements.

According to this arrangement, it is possible to provide an image forming device including a developing device which is silent, small in size, and capable of reducing costs.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

Industrial Applicability

With the arrangements above, it is possible to obtain (i) a developing device which is capable of: restraining the degradation of image quality caused by the irregularity of density; preventing unpleasant noise generated because of the vibration of a belt member; improving the quietness; and downsizing and cost-cutting, and (ii) an image forming device including this developing device.

What is claimed is:

1. A developing device, comprising:

developing agent carrying means for carrying a developing agent towards an image supporter, using an electric field in which distribution of electric potentials varies in a manner of traveling waves having a predetermined direction of movement;

a belt member which is provided so as to cover a surface of the developing agent carrying means, the surface facing the image supporter;

drive means which is in touch with the belt member, for rotating the belt member around the developing agent carrying means; and drive assistance means which is provided so as to sandwich the belt member with the drive means.

2. The developing device as defined in claim 1, wherein the drive means is provided so as to be in touch with a surface of the belt member, the surface being opposite to a surface for carrying the developing agent.

3. The developing device as defined in claim 1, wherein the drive means and the drive assistance means are in touch with the belt member so as to rotate at different peripheral velocities.

4. The developing device as defined in claim 2, wherein the drive assistance means is in touch with the belt member so as to rotate at a peripheral velocity higher than a peripheral velocity of the drive means.

5. The developing device as defined in claim 2, wherein friction coefficient between the belt member and the drive means is higher than friction coefficient between the belt member and the drive assistance means.

6. The developing device as defined in claim 1, wherein a portion of the drive means, where the drive means is in touch with the belt member, is composed of an elastic member.

7. The developing device as defined in claim 1, wherein a portion of the drive assistance means, where the drive assistance means is in touch with the belt member, is composed of an elastic member.

8. The developing device as defined in claim 7, wherein, the drive means and the drive assistance means are respective columns which are in touch with the belt member so as to rotate, a radius of the drive means is longer than a radius of the drive assistance means, and the elastic member located at the portion where the drive assistance means is in touch with the belt member is softer than the elastic member located at the portion where the drive means is in touch with the belt member.

9. The developing device as defined in claim 1, wherein at least either one of the drive means and the drive assistance means has a surface composed of a conductive member.

10. The developing device as defined in claim 9, wherein at least either one of the drive means and the drive assistance means can be applied a voltage opposite to a voltage of the belt member.

11. The developing device as defined in claim 10, wherein at least either one of the drive means and the drive assistance means can be applied an alternating voltage.

12. The developing device as defined in claim 10, wherein a portion of the belt member, the portion being sandwiched between the drive means and the drive assistance means, is shorter than a width of the belt member.

13. The developing device as defined in claim 1, wherein volume resistivity of the belt member is within a range of $1\times10^{8}$ Ω.cm to $1\times10^{16}$ Ω.cm.

14. The developing device as defined in claim 1, further comprising cleaning means for removing the developing agent on the belt member.

15. The developing device as defined in claim 14, wherein the cleaning means is provided on an upstream side of a rotative direction of the belt member, with respect to the drive assistance means.

16. The developing device as defined in claim 1, further comprising tension control means for imparting tension to the belt member and controlling the tension.

17. The developing device as defined in claim 16, wherein the tension control means is in touch with a surface of the belt member, the surface being opposite to a surface for carrying the developing agent.

18. An image forming device, comprising the developing device as defined in claim 1.

* * * * *